US009004080B2

(12) United States Patent
Büsing et al.

(10) Patent No.: US 9,004,080 B2
(45) Date of Patent: Apr. 14, 2015

(54) WATER-BEARING DOMESTIC APPLIANCE INCLUDING A SUSPENSION APPARATUS WITH ATTACHMENT MEANS FORMED BY OPENINGS THROUGH THE BASE BODY

(75) Inventors: Johannes Büsing, Emersacker (DE); Stefan Kasbauer, Dillingen (DE); David Semerad, Holzheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 934 days.

(21) Appl. No.: 12/999,068

(22) PCT Filed: Jun. 18, 2009

(86) PCT No.: PCT/EP2009/057591

§ 371 (c)(1),
(2), (4) Date: Jan. 13, 2011

(87) PCT Pub. No.: WO2009/156325

PCT Pub. Date: Dec. 30, 2009

(65) Prior Publication Data

US 2011/0120509 A1 May 26, 2011

(30) Foreign Application Priority Data

Jun. 24, 2008 (DE) ..... 10 2008 029 913

(51) Int. Cl.
*A47L 15/42* (2006.01)
*D06F 37/00* (2006.01)
(Continued)

(52) U.S. Cl.
CPC ..... *D06F 37/20* (2013.01); *A47L 15/4225* (2013.01); *A47L 15/4246* (2013.01); *D06F 39/085* (2013.01)

(58) Field of Classification Search
CPC ..... D06F 37/22; D06F 37/20; D06F 37/206; D06F 37/263; D06F 37/266; D06F 37/267; D06F 37/268; D06F 37/269; D06F 39/125; D06F 39/085; D06F 58/206; F16F 7/09; F16F 7/128; F16F 7/126; F16F 7/123; F16F 7/12; F16F 9/54; F16F 13/108; F16F 13/14; F16F 1/38; F16F 1/3849; F16F 13/149; F16F 13/1481; F16F 13/24; F16F 15/207; F16F 2230/0005; A47L 15/4225; A47L 9/22
USPC ..... 68/140, 12.04, 12.06, 23.1; 134/117, 134/127
See application file for complete search history.

(56) References Cited

U.S. PATENT DOCUMENTS 4,019,346 A * 4/1977 Fukuda ..... 464/8
6,888,620 B2 * 5/2005 Lee et al. ..... 355/73
(Continued)

FOREIGN PATENT DOCUMENTS

DE 2157590 A1 5/1973
DE 9215365 U1 3/1994
(Continued)

OTHER PUBLICATIONS

Machine English Translation of Specification of EP1245859 (Mack, et al.).*
(Continued)

*Primary Examiner* — Michael Barr
*Assistant Examiner* — Irina Graf
(74) *Attorney, Agent, or Firm* — James E. Howard; Andre Pallapies

(57) ABSTRACT

A water-bearing domestic appliance is provided which has an appliance element and an appliance component that is attached to the appliance element at a suspension point. The suspension point is disposed in a region of the center of gravity of the appliance component.

16 Claims, 6 Drawing Sheets

(51) Int. Cl.

| | |
|---|---|
| ***F16F 15/04*** | (2006.01) |
| ***D06F 37/20*** | (2006.01) |
| ***D06F 39/08*** | (2006.01) |

(56) References Cited

U.S. PATENT DOCUMENTS

| | | | | |
|---|---|---|---|---|
| 7,247,974 | B2 * | 7/2007 | Bansemir et al. | 310/328 |
| 2005/0173997 | A1 * | 8/2005 | Schmid et al. | 310/51 |
| 2005/0283938 | A1 * | 12/2005 | Theiss et al. | 15/320 |

FOREIGN PATENT DOCUMENTS

| | | | | |
|---|---|---|---|---|
| DE | 102006050015 | A1 * | 2/2008 | D06B 3/30 |
| EP | 1245859 | A3 | 1/2004 | |
| EP | 1568895 | A1 * | 8/2005 | F16B 2/08 |

OTHER PUBLICATIONS

Machine English Translation of Specification DE2157590 (Licentia GmB).*

English Machine Translation of Description of DE102006050015A1 (Wolf et al. 2008).*

* cited by examiner

WATER-BEARING DOMESTIC APPLIANCE INCLUDING A SUSPENSION APPARATUS WITH ATTACHMENT MEANS FORMED BY OPENINGS THROUGH THE BASE BODY

BACKGROUND OF THE INVENTION

The invention relates to a water-bearing domestic appliance.

It is known that circulation pumps can be fitted by means of two or more suspension elements in water-bearing domestic appliances, such as dishwashers for example. This allows both the weight of the circulation pump and any torque, vibrations and oscillations it generates to be absorbed. Until now the circulation pumps in appliances with containers above said circulation pumps were either suspended at the bottom from a base part or with additional parts from the container. This has the disadvantage that a plurality of necessary suspension elements means high costs and involves increased fitting outlay.

BRIEF SUMMARY OF THE INVENTION

The object of the invention is therefore to provide a water-bearing domestic appliance with a noise-reducing attachment for an appliance component.

The invention is based on a water-bearing domestic appliance, in particular a dishwasher or washing machine, at least featuring an appliance element, to which an appliance component is attached at a suspension point.

According to the invention provision is made for the suspension point to be disposed in the region of the center of gravity of the appliance component. Attachment is therefore possible at just one point, the mechanical load being reduced by the selection of the suspension point, so that the suspension can be executed correspondingly compactly, which reduces the transfer of pump oscillation to other parts.

A suspension apparatus is preferably provided here for attaching the appliance component. The use of a single suspension apparatus saves costs, as only a single part has to be produced, stored and fitted.

Provision is also preferably made for the suspension apparatus to feature at least one elastic segment. This allows oscillations and vibration to be damped or completely absorbed. This results in further noise reduction. The elasticity of the elastic base body is selected here so that it has sufficient rigidity to ensure the absorption of torque in the case of appliance elements that generate torque.

Provision is preferably made for the suspension apparatus to feature at least a first and a second attachment means, which are disposed at a distance from one another. The first and second attachment means here are preferably formed by openings through a base body of the suspension apparatus. Provision is also preferably made for a first plug-in pin to be provided on the appliance element and a second plug-in pin to be provided on the appliance component, the first plug-in pin being inserted into the one opening and the second plug-in pin being inserted into the other opening. This makes it very simple to fit the suspension apparatus, both for a human fitter and also using a fitting apparatus.

According to one development of the invention provision is made for the base body to feature at least one constriction located between the openings. The constriction makes the base body more flexible in the region of the constriction, in order to be able to damp and/or adsorb oscillations and vibrations. As the constriction is disposed between the openings, a more rigid base body region results in the region of the openings, featuring a high level of stability and less elasticity. This protects the openings and pins from overstressing, which could cause the pins or base body material to tear, and yet the base body still has damping and adsorbing properties in respect of vibrations and oscillations.

It is advantageous if the constriction is disposed centrally between the openings. A central position results in a particularly good distribution of mechanical tensions produced by the oscillations and vibrations and any torque present. A homogenous mechanical tension profile results within the base body, resulting in a long service life of the base body.

According to one development of the invention provision is made for at least one of the openings to be configured with a non-round, in particular triangle-type, cross section. The non-round embodiment of the cross section of the opening, in other words of the opening cross section, allows it to accommodate plug-in pins configured in different ways.

According to one development of the invention provision is made for each of the openings to feature an opening profile, at least two of the openings featuring an opening profile of identical orientation. With this advantageous embodiment each opening has a longitudinal extension, which continues in particular orthogonally in relation to the cross section and which represents the opening profile. The fact that the opening profiles of at least two openings have identical orientation allows the accommodation of plug-in pins, the longitudinal extension of which likewise has identical orientation. This results in simple fitting, as the plug-in pins can be inserted into the openings with opening profiles of identical orientation with a simple movement. The identical orientation of the opening profiles also simplifies aspects of production, since for example the same tool can be used to produce the openings or the opening can already be provided in a simple manner during production of the base body and does not have to be produced at a later stage.

According to one advantageous development provision is made for at least one of the plug-in pins to feature a non-round cross section. The non-round cross section of the plug-in pin is in particular advantageous when the associated opening in the base body is also embodied as non-round.

According to one development of the invention provision is made for the cross sections of the openings and the plug-in pins to be matched to one another in respect of form. If the cross sections are matched to one another, fitting can take place in a very simple manner without a major force outlay. The service life of the suspension apparatus is also lengthened by preventing tension and friction effects.

According to one development of the invention provision is made for the plug-in pin to be held in the opening in such a manner that it is prevented from twisting due to the forms of the opening and plug-in pin cross sections. Provision is made for the non-round cross section of the plug-in pin to accommodate the base body in such a manner that it is completely or partially prevented from twisting about the longitudinal extension of the plug-in pin. The plug-in pins here can feature the same cross section as the openings, which optimizes prevention of the base body from twisting. The plug-in pin is preferably configured so that the plug-in pin is disposed in the opening in such a manner that it is prevented from twisting but does not feature the complete cross section of the opening. In the case of a triangle-type opening cross section for example, this can happen with a plug-in pin which features a T-shaped cross section, each of the three ends of the T shape being disposed in a corner of the triangle-type opening cross section. Such matching of form allows plug-in pins to be produced in a material-saving manner.

According to one advantageous development provision is made for the plug-in pin to feature an engaging step that engages behind the base body. The engaging step here engages behind the base body after being fitted perpendicular to the opening profile. This means that during fitting, in other words when the base body is being fitted onto the plug-in pin, an engaging step is passed through the opening. After fitting, the engaging step is again located outside the opening profile, to secure against removal. This prevents the base body being removed inadvertently from the plug-in pin due to oscillations and/or vibrations. The engaging step here is advantageously configured at right angles to the opening profile, while a part of the plug-in pin in front of the engaging step, in other words the part that passes into the opening first during fitting, should be provided with an arrow shape, which widens the opening in a gentle manner during fitting.

According to one development of the invention provision is made for the plug-in pins each to feature an insertion orientation, with at least two of the plug-in pins having identical insertion orientation. The insertion orientation is the orientation along the longitudinal extension of the plug-in pin, in which the plug-in pin is inserted into the opening during fitting. If a number of plug-in pins have identical insertion orientation, in particular together with openings which feature the opening profile of identical orientation, very simple fitting is possible. It is then possible to position the base body simultaneously on the plug-in pins with a single linear movement and thus to fit the base body and actively install the suspension apparatus.

According to one development of the invention provision is made for the base body to feature a longish shape with two end regions, the openings being disposed in the end regions. Since a load held by the base body acts primarily between the openings, it is advantageous to dispose the openings in the end regions. Sufficient wall must remain around the opening cross section, being able to absorb the load and forces provided for without suffering damage.

According to one development of the invention provision is made for the base body to feature a bone shape. The base body thus has two end regions, which are connected to one another by way of a constriction. Provision is made in particular here for the end regions to have mirror symmetry to one another across the constriction. With the embodiment in a bone shape the openings are also preferably disposed in the end regions of the bone shape.

According to one development of the invention provision is made for the base body to be provided with at least one reinforcing rib. Such a rib allows specific local reinforcement of the regions where it is disposed. The arrangement of one or more ribs thus allows the base body to be designed very precisely and in a material-saving manner for its area of deployment.

According to one development of the invention provision is made for the reinforcing rib to be configured with material uniformity with the base body material of the base body. In this embodiment the reinforcing rib is part of the base body in respect of material. The reinforcing rib is already produced during production of the base body, thereby saving an additional production step of subsequent attachment of the reinforcing rib.

According to one development of the invention provision is made for the appliance element to be a pump sump or a base sump of a dishwasher forming the domestic appliance.

According to one development of the invention provision is made for the appliance component to be a pump, in particular a circulation pump, of the dishwasher. This has the advantage that the base body and therefore the suspension apparatus can absorb vibrations, oscillations and torque typically produced by the pump, thereby ensuring that the circulation pump is held securely. Provision is made in particular here for the pump to be suspended from the pump sump or the base sump of the dishwasher by means of the suspension apparatus. It is also conceivable to attach other appliance components, such as hoses and pipes for example, by means of the suspension apparatus. Similarly the suspension apparatus can also be deployed in different product series of the domestic appliance, resulting in an additional cost saving in respect of planning, production and storage.

BRIEF DESCRIPTION OF THE DRAWINGS

The invention is illustrated with reference to an exemplary embodiment in the drawings, in which.

DETAILED DESCRIPTION OF EXEMPLARY EMBODIMENTS OF THE PRESENT INVENTION

Figure 1:
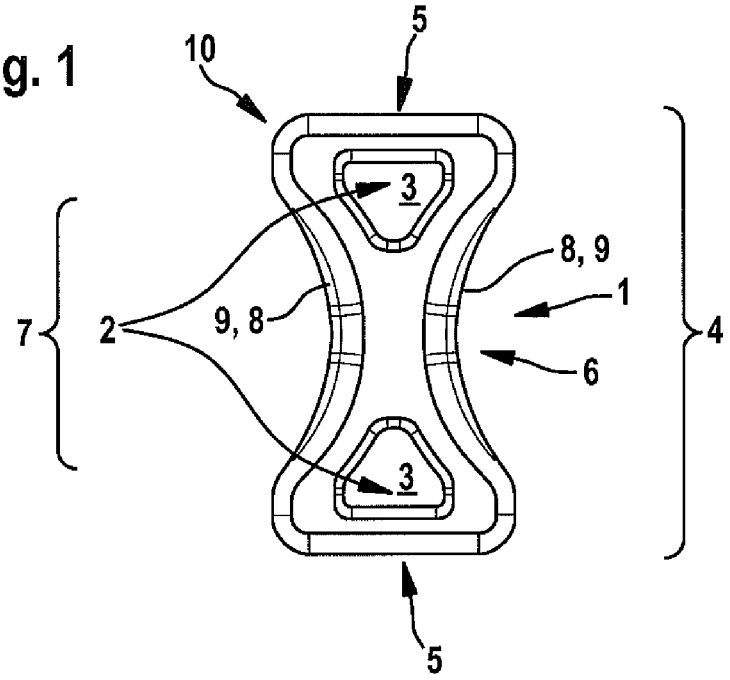
FIG. 1 shows a front view of a base body.

FIG. 1 shows a top view of a base body 1 featuring two openings 2, each featuring a triangle-type cross section 3. The triangle-type cross sections 3 are oriented so that the heights of the triangle-type cross sections 3 lie on a straight line (not shown), with one corner of each cross section 3 pointing to the other cross section 3. The base body 1 has a longish shape 4 with two end regions 5, in which the openings 2 are respectively disposed. The base body 1 also features a constriction 6, which results from the base body 1 tapering from the end regions 5 respectively to the constriction. A taper region 7 thus results. The constriction 6 is disposed centrally between the openings 2. The constriction 6 is also disposed centrally in the taper region 7. The base body 1 features two ribs 8, which are configured as reinforcing ribs 9 and extend along the taper region 7. The reinforcing ribs 9 are configured with material uniformity with the base body 1, in other words they—the base body 1 and the reinforcing ribs 9—are both made of the same material and are configured as a single piece. The base body 1 as a whole has a bone shape 10 when viewed from above.

Figure 2:
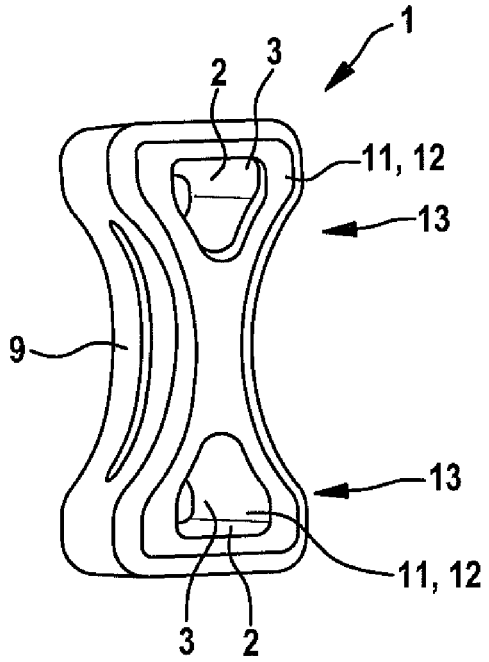
FIG. 2 shows a perspective view of the base body from FIG. 1.

FIG. 2 shows a perspective view of the base body 1 from FIG. 1. It shows clearly that the openings 2 each feature an opening profile 13, which runs orthogonally in relation to the cross sections 3 of the openings. This means that the openings 2 have a cylinder-type wall 11, which is embodied as a triangle-type cylinder 12. One of the reinforcing ribs 9 can be seen in a perspective view. The reinforcing rib 9 extends over the entire taper region 7, having only a narrow width. The opening profiles 13 feature identical orientation in relation to one another.

Figure 3:
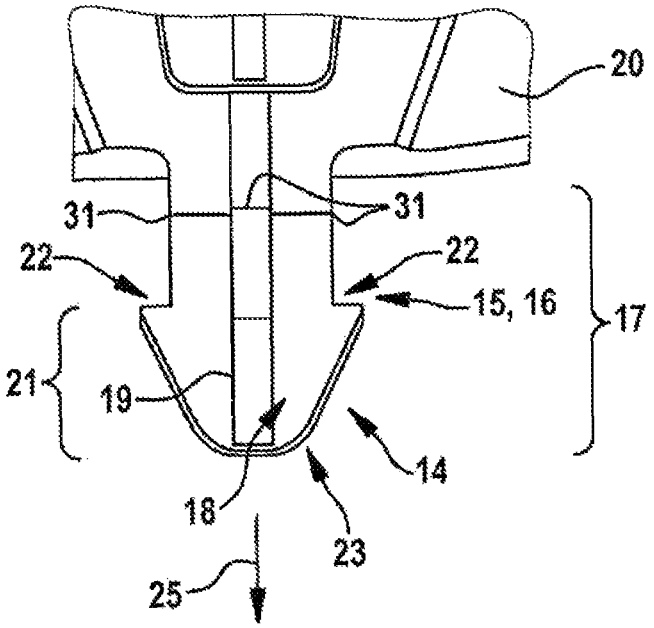
FIG. 3 shows a top view of a plug-in pin.

FIG. 3 shows a top view of a plug-in pin 14. The plug-in pin 14 here has a non-round cross section 15, which is configured as a T-shaped cross section 16 with end segments 31. An identifiable base plate 18 therefore results along a longitudinal extension 17 for the plug-in pin, on which base plate 18 a pin rib 19 is positioned at right angles when viewed in the T-shaped cross section 16. The plug-in pin 14 is attached to an appliance component 20 and extends to a front region 21. Two engaging steps 22 are configured on the base plate 18 between the front region 21 and the appliance component 20. In the front region 21 the plug-in pin 14 forms an arrow shape 23, which is oriented away from the appliance component 20 in the direction of the longitudinal extension 17. The pin rib 19 likewise features an arrow shape 24 with such orientation in the front region 21. The arrow shapes 23 and 24 thus point in an insertion direction 25, which also lies in the longitudinal extension 17 of the plug-in pin 14. The insertion direction 25 describes the direction in which the plug-in pin 14 is inserted into the base body 1 for fitting purposes.

Figure 4:
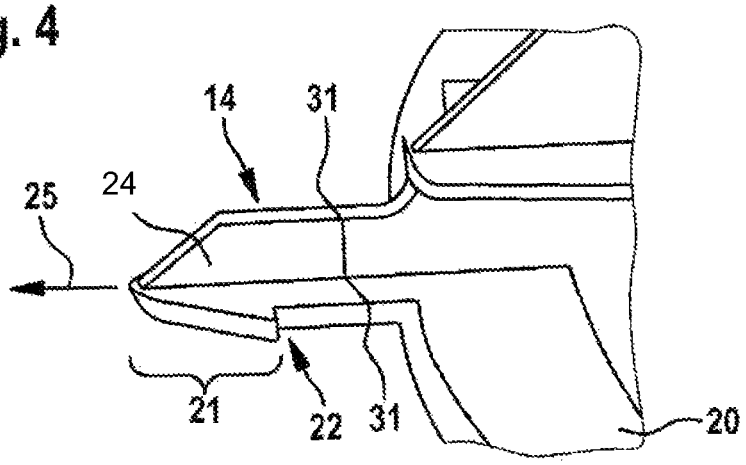
FIG. 4 shows a perspective view of the plug-in pin from FIG. 3.

FIG. 4 shows a perspective side view of the plug-in pin 14, illustrating the pin rib 19 and the insertion direction 25.

Figure 5:
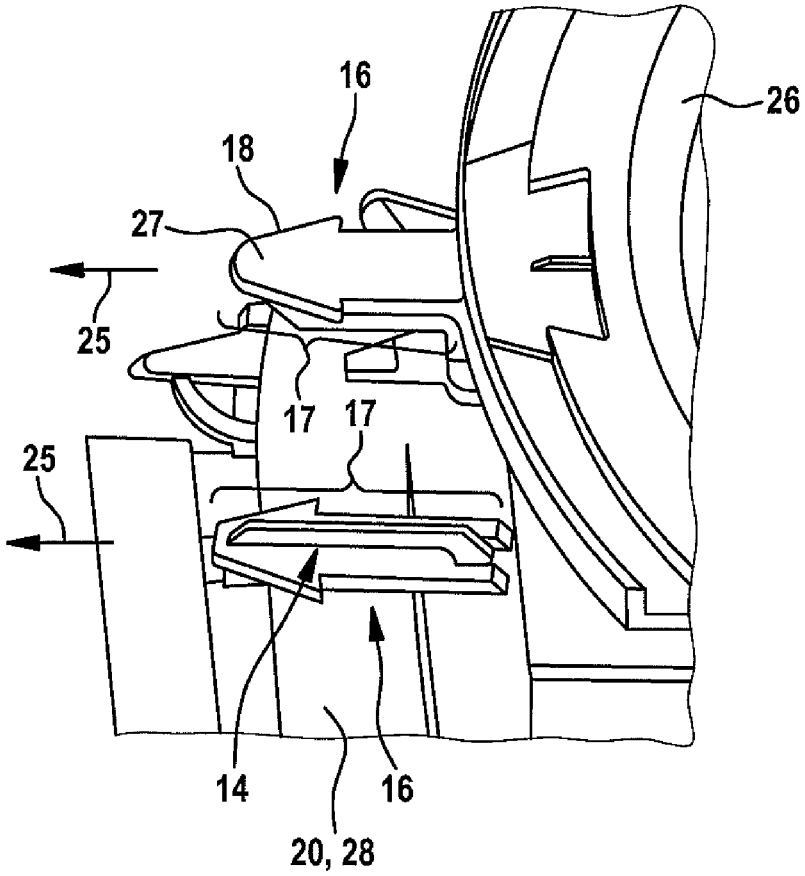
FIG. 5 shows a perspective view of two plug-in pins.

FIG. 5 shows an appliance element 33 configured as a pump sump 26, featuring an upper plug-in pin 27. The appliance component 20 is also shown segmented in the form of a circulation pump 28 of a dishwasher (not shown). The circulation pump 28 features the lower plug-in pin 14. The plug-in pins 14 and 27 are configured identically along their longitudinal extension 17 and both feature the T-shaped cross section 16 and the front region 21, as described in FIGS. 3 and 4. The upper plug-in pin 27 differs from the lower plug-in pin 14 in that the base plate 18 of the upper plug-in pin 27 is oriented away from the lower plug-in pin 14. This means that the T-shaped cross section 16 of the upper plug-in pin 27 is reversed through 180° in relation to the T-shaped cross section 16 of the lower plug-in pin 14. Both plug-in pins 14 and 27 feature the insertion direction 25, which is oriented identically in respect of the plug-in pins.

Figure 6:
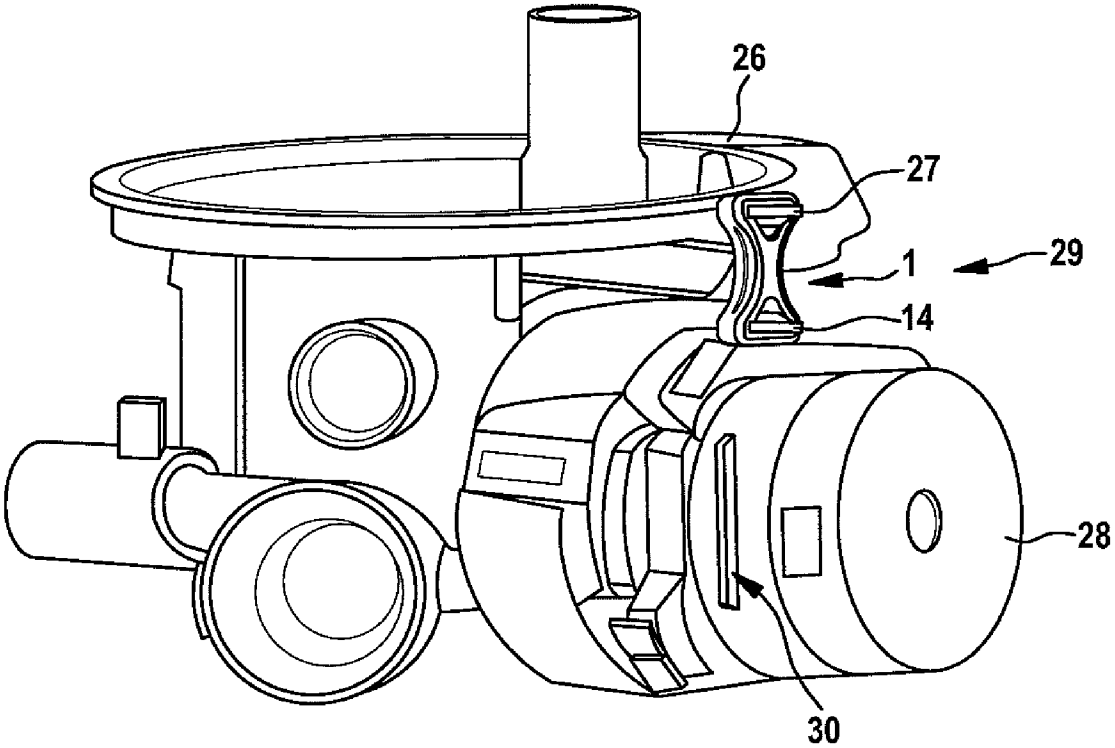
FIG. 6 shows a suspension apparatus connecting a pump sump to a circulation pump.

FIG. 6 shows a suspension apparatus 29, consisting of the plug-in pins 27 and 14 and the base body 1. The suspension apparatus 29 thus connects the circulation pump 28 to the pump sump 26 in a secure manner. Provision is made here for the base body 1 to be disposed above the center of gravity 30 of the circulation pump 28, in other words above along a vertical line to the center of gravity 30.

To fit the suspension apparatus 29 it is only necessary to position the base body 1 on the plug-in pins 14 and 27 counter to the insertion direction 25. This can be done by a simple linear movement, as the insertion directions 25 of the plug-in pins 14 and 27 and the opening profiles 13 of the base body 1 are oriented in an identical manner. During insertion the arrow shape 23 widens the cross section 3 of the opening 2 in the base body 1, without damaging it. When insertion has been completed, the base body with its openings 2 is located behind the front regions 21 of the plug-in pins 14 and 27. The engaging steps 22 then prevent removal of the base body 1 from the plug-in pins 14 and 27. The reverse orientation of the base plates 18 between the plug-in pins 14 and 27 prevents damage and therefore any tearing of the elastic material of the base body 1. This embodiment allows the forces occurring to be distributed optimally in the openings 2. The embodiment of the T-shaped cross sections 16 of the plug-in pins 14 and 27 is selected so that the base plates 18 feature the same width away from the front regions 21 as the widths of the sides of the triangle-type cross sections 3 adjacent to them after fitting. The pin rib 19 then forms the height of the triangle-type cross section 3 away from the front region 21. There is therefore one of the end segments 31 of the T-shaped cross section 16 in each corner of the triangle-type cross section 3. The matched forms of the cross sections 3 and 16 ensure that each of the plug-in pins 14 and 27 is held in the openings in such a manner that it is prevented from twisting. In other words the base body 1 also cannot be twisted in a direction about the longitudinal extension 17 of the plug-in pin 14 and 27. This twist-preventing form allows torque applied by the circulation pump 28 to be absorbed and transmitted from the lower plug-in pin 14 by way of the base body 1 to the upper plug-in pin 27. The bone shape 10 of the base body 1 damps any oscillations occurring in this process and establishes a continuous force transfer when torque occurs suddenly.

Figure 7:
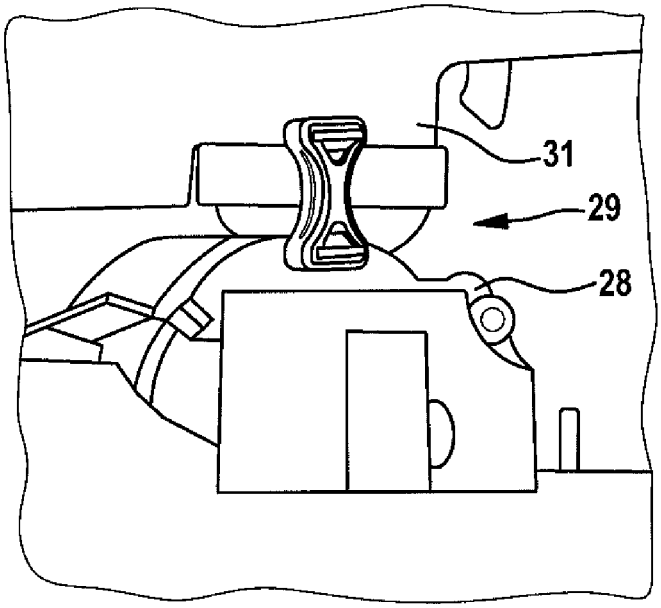
FIG. 7 shows a suspension apparatus connecting a base sump to a circulation pump and FIG. 8 shows a suspension apparatus connecting a circulation pump to a pipe.

FIG. 7 shows a further embodiment of the suspension apparatus 29, the circulation pump 28 being connected to a base sump 31 in the same manner as shown in FIG. 6.

Figure 8:
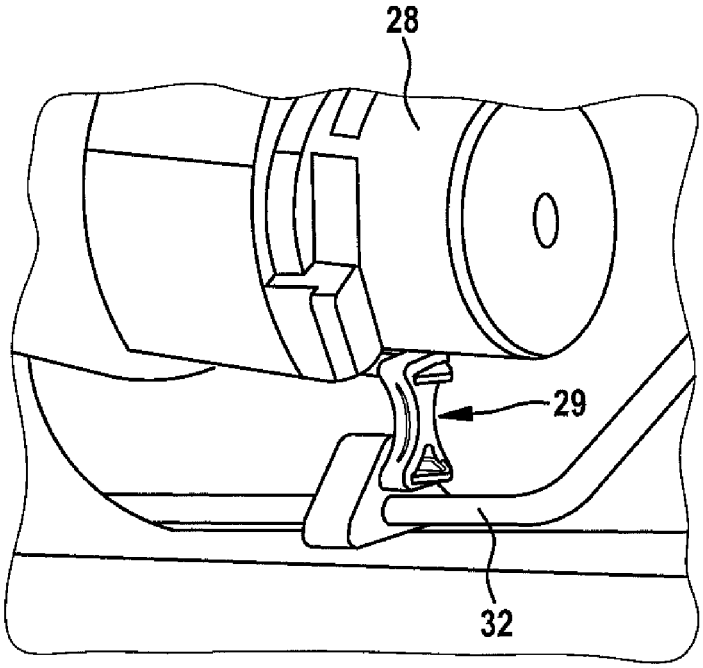

FIG. 8 shows an additional embodiment of the suspension apparatus 29. In this embodiment a pipe 32 is attached to the circulation pump 28 by means of the suspension apparatus 29.

The embodiment of the base body 1 illustrated in FIGS. 1 and 2 can also be produced by extrusion. The lateral reinforcing ribs 9 are then not required. It is thus possible to form the base body 1 by cutting an extruder strand to length, which is not shown here.

The invention claimed is:

1. A water-bearing domestic appliance, comprising:

an appliance element;

an appliance component attached to the appliance element at a suspension point, wherein the suspension point is disposed in a predetermined region of the center of gravity of the appliance component; and a suspension apparatus for attachment of the appliance component, wherein the suspension apparatus has a first attachment means and a second attachment means that are disposed at a distance from one another and wherein the suspension apparatus has a base body, and wherein the first attachment means and the second attachment means are formed by separate openings through the base body of the suspension apparatus, wherein at least one of the separate openings has a triangle shaped cross section;

wherein the appliance element has a plug-in pin and the appliance component has a plug-in pin, and wherein the appliance element plug-in pin is inserted into a first one of the openings and the appliance component plug-in pin is inserted into a second one of the openings;

wherein the appliance element plug-in pin and the appliance component plug-in pin are held in the respective first and second openings configured to prevent twisting due to respective forms of the respective cross sections of the first and second openings and the appliance element plug-in pin and appliance component plug-in pin.

2. The water-bearing domestic appliance of claim 1, wherein the water-bearing domestic appliance is one of a dishwasher and a washing machine.

3. The water-bearing domestic appliance of claim 1, wherein the suspension apparatus has an elastic segment.

4. The water-bearing domestic appliance of claim 1, wherein the base body has a constriction that is located between the first and the second openings.

5. The water-bearing domestic appliance of claim 4, wherein the constriction is disposed centrally between the first and the second openings.

6. The water-bearing domestic appliance of claim 1, wherein profiles of the first and the second openings are identical.

7. The water-bearing domestic appliance of claim 1, wherein each of the appliance element plug-in pin and the appliance component plug-in pin has a non-round cross section.

8. The water-bearing domestic appliance of claim 1, wherein respective cross sections of the openings of the appliance element plug-in pin and the appliance component plug-in pin are matched to one another with respect to form.

9. The water-bearing domestic appliance of claim 1, wherein each of the appliance element plug-in pin and the appliance component plug-in pin has a respective engaging step.

10. The water-bearing domestic appliance of claim 1, wherein each of the appliance element plug-in pin and the appliance component plug-in pin has a respective insertion orientation, and has an identical insertion orientation.

11. The water-bearing domestic appliance of claim 1, wherein the base body has an elongated shape with two end regions, and wherein the openings are disposed in the two end regions.

12. The water-bearing domestic appliance of claim 1, wherein the base body has a reinforcing rib.

13. The water-bearing domestic appliance of claim 12, wherein the reinforcing rib is configured of a same material as the base body.

14. The water-bearing domestic appliance of claim 1, wherein the appliance element is one of a pump sump and a base sump of a dishwasher.

15. The water-bearing domestic appliance of claim 1, wherein the appliance component is a pump of a dishwasher.

16. The water-bearing domestic appliance of claim 15, wherein the pump is a circulation pump.

* * * * *